US005979486A

United States Patent [19]

Davidson

[11] Patent Number: 5,979,486

[45] Date of Patent: Nov. 9, 1999

[54] INTERNAL BREATHING FOR VACUUM INTERFACE VALVE OF VACUUM SEWAGE SYSTEM

[75] Inventor: Keith M. Davidson, Evesham, United Kingdom

[73] Assignee: EuroIseki Ltd., United Kingdom

[21] Appl. No.: 09/164,960

[22] Filed: Oct. 1, 1998

[51] Int. Cl.[6] ..... F04F 3/00

[52] U.S. Cl. ..... 137/205; 137/236.1; 137/907

[58] Field of Search ..... 137/205, 236.1, 137/364, 907

[56] References Cited

U.S. PATENT DOCUMENTS 4,691,731 9/1987 Grooms et al. .

5,069,243 12/1991 Foreman .

5,570,715 11/1996 Featheringill et al. .

5,615,701 4/1997 Yamabe et al. ..... 137/205

*Primary Examiner*—Gerald A. Michalsky

*Attorney, Agent, or Firm*—Eugene Stephens & Associates

[57] ABSTRACT

An internal breathing system for a vacuum interface valve in a vacuum sewage system uses a vent port arranged in a partition between a remotely vented sump and a valve chamber for the vacuum interface valve located above the sump. A float valve normally opens the vent port to admit approximately atmospheric pressure air from the sump to the valve chamber, and the float valve closes the vent port if a mishap causes sewage to rise high enough to float the valve. Conduits preferably provide breathing communication for the vacuum interface valve and its controller from a region high in the valve chamber to avoid accidental transmission of sewage or condensate.

17 Claims, 1 Drawing Sheet

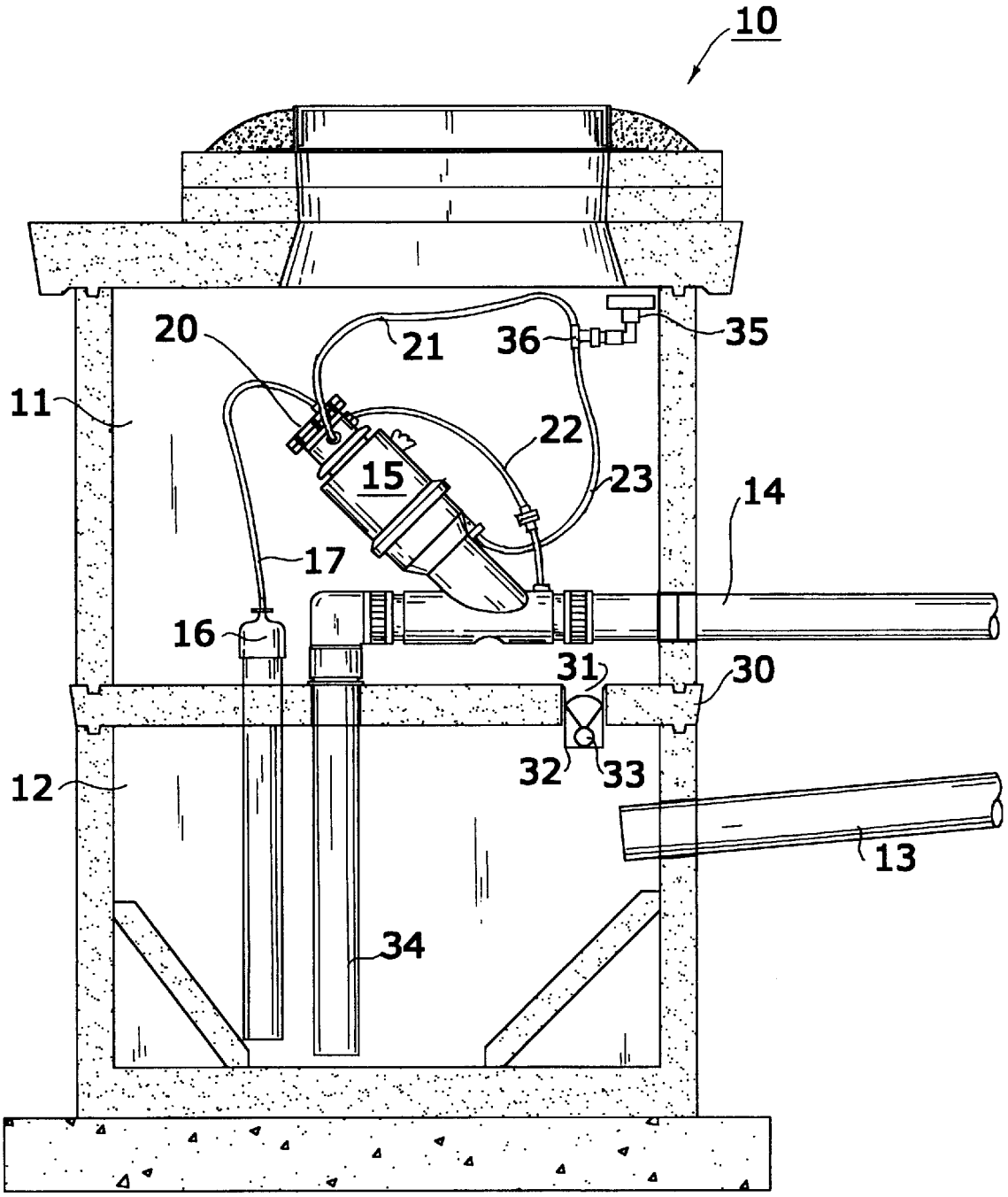
10
20
21
36
35
11
22
15
23
14
17
16
31
30
32
33
12
13
34

INTERNAL BREATHING FOR VACUUM INTERFACE VALVE OF VACUUM SEWAGE SYSTEM

TECHNICAL FIELD

Vacuum sewage collecting systems using collection sumps emptied by vacuum interface outflow valves.

Background

A vacuum-powered interface valve and its controller need communication with approximately atmospheric pressure air to operate reliably in a vacuum sewage system. Atmospheric breathing of the valve and its controller can be provided by a vent tube near a collection sump and valve chamber, as suggested in U.S. Pat. No. 5,069,243; but this requires an above ground vent pipe that internal breathing systems can eliminate. Suggestions for such internal breathing systems occur in U.S. Pat. Nos. 4,691,731 and 5,570,715. These supply approximately atmospheric pressure air to a sewage collection sump via a remote above ground vent pipe communicating with a gravity sewage discharge pipe leading from a building to a collection sump. This places the above ground vent tube conveniently near a building and eliminates the need for such a vent tube near the collection sump and valve chamber.

Although internal breathing arrangements for vacuum sewage systems eliminate above ground vent pipes near valve chambers and sumps, they have also involved many problems of expense and malfunction. Prior art internal breathing systems have required conduits extending from the valve and its controller to the wet sump; and under some circumstances, this can cause sewage to be drawn into a valve controller, which can cause a breakdown and require a repair. Air from a wet sump is also often moist and sometimes warm so that condensation can occur in vent conduits communicating with collection sumps, and this also can be harmful to valve controllers.

I have devised a more reliable and less expensive way of accomplishing internal breathing for a vacuum sewage system to eliminate the need for any above ground vent in the vicinity of a valve chamber and a collection sump. My system improves over the prior art in avoiding condensation in vent lines, keeping sewage away from the valve and its controller, and reducing the expense of an internal breathing system.

SUMMARY OF THE INVENTION

My internal breathing system applies to a vacuum sewage system having a vacuum-operated interface valve in a valve chamber positioned above a sewage collection sump and separated from the sump by a wall or partition. I arrange a vent port in the partition to allow vent communication between the sump and the valve chamber whenever the vent port is open. A float valve normally opens the vent port whenever sewage in the sump is at normal levels, and the float valve closes the vent port whenever sewage rises to the float valve level. This reliably keeps sewage from entering the valve chamber.

A controller for the vacuum interface valve is in vented communication with air in the valve chamber. This air is at approximately atmospheric pressure whenever the float valve is open. A tube or conduit preferably extends from the valve controller to an upper region of the valve chamber for vent purposes. Preferably another tube extends from the upper vent region of the valve chamber to the vacuum interface valve so that the valve and its controller can breathe valve chamber air in and out during operation. This arrangement inexpensively keeps sewage and condensate out of the valve and its controller and also keeps the valve chamber dry.

DRAWING

The partially schematic drawing shows a valve chamber and a sewage sump arranged for internal breathing according to my invention.

DETAILED DESCRIPTION

My internal breathing arrangement 10 for a vacuum sewage system includes a valve chamber 11 arranged above a wet sump 12 for collecting sewage via one or more gravity discharge lines 13 leading from buildings. Wet sump 12 is remotely vented to atmosphere via a gravity collection line 13, and this is preferably accomplished in a known way by using an above ground vent (not shown) venting collecting line 13 near a building. This arrangement gives sump 12 access to approximately atmospheric pressure air.

Vacuum interface valve 15 opens outflow line 14 to discharge sewage from sump 12 through vacuum line 14, as more fully explained in U.S. Pat. No. 5,069,243, the disclosure of which is hereby incorporated by reference. A controller 20 operates valve 15 to discharge sewage in response to a rising level of sewage in sump 12 causing above atmospheric air pressure in a sensor tube 16 to be communicated to controller 20 via a conduit 17. Controller 20 also has access to approximately atmospheric pressure air via line 21 and to vacuum via line 22, and valve 15 has access to atmospheric air via line 23. With such an arrangement, controller 20 can operate valve 15 whenever sewage rises to a predetermined level in sump 12. Whenever valve 15 opens, atmospheric pressure in sump 12 forces sewage rapidly out through the vacuum sewer in outflow pipe 14, via the intake pipe 34.

A partition or wall 30 separates valve chamber 11 and sump 12, and a vent port 31 extends through partition 30. A float valve 32 is preferably arranged in vent port 31 so that a float ball 33 can close vent port 31 against a rising sewage level. If a system failure allows sewage level to rise in sump 12 high enough to float ball 33, it closes float valve 32 and blocks vent port 31 so that sewage cannot enter valve chamber 11.

During normal operation, though, sewage in sump 12 remains well below float valve 32 so that ball valve 33 normally opens vent port 31. This allows vent communication of approximately atmospheric pressure air between sump 12 and valve chamber 11. During a mishap causing a high sewage level in sump 12 and blockage of vent port 31, controller 20 and valve 15 can still breathe air trapped in valve chamber 11.

The necessary venting of valve 15 and its controller 20 via conduits 23 and 21 is preferably arranged in an upper region of valve chamber 11 high above sump 12 and partition 30. A guard 35, preferably in the form of a screen or filter, provides air access to conduits 21 and 23 while inhibiting passage of insects and any other foreign material or objects.

This arrangement keeps conduits 21 and 23 fairly free of condensation that can occur when warm moist air from sump 12 rises into a colder environment in valve chamber 11. Condensation will occur mostly on walls and other surfaces before such air enters tubes 21 and 23. Also, any condensation that does occur in the valve breathing system will preferably be directed downward by arranging tube 23 below tube 21. This can be done by a T 36 directing any condensate through tube 23 to the lower chamber of valve 15 where the vacuum sewer will harmlessly remove it via the non-return outflow valve (described in U.S. Pat. No. 5,069, 243).

The high level of guarded entrance 35 to conduits 21 and 23 also ensures that mishaps involving ground water or sewage entering valve chamber 11 will not impair the breathing of vacuum interface valve 15 unless valve chamber 11 becomes completely flooded, which is highly unlikely. Also, if ground water or sewage does enter valve chamber 11, it can later drain back through vent port 31 into wet sump 12.

Avoiding communicating connection between sump 12 and conduits 21 and 23 avoids possible problems of drawing sewage into controller 20 or valve 15. Avoiding such connections also simplifies and reduces the expense of my internal breathing arrangement.

I claim:

1. In combination with a vacuum sewage system having a sewage collection sump remotely vented to atmosphere, a vacuum interface valve arranged in a valve chamber above the sump, and a partition between the valve chamber and the sump, an internal breathing system comprising:

a. a vent port in the partition;

b. a float valve disposed to normally open the vent port to allow vent communication between the valve chamber and the sump;

c. the float valve being arranged to close the vent port in response to sewage rising in the sump to a level of the float valve; and d. a controller for the vacuum interface valve being in vented communication with air in the valve chamber.

2. The system of claim 1 including a vent tube communicating between the controller and an upper region of the valve chamber.

3. The system of claim 2 including a guard arranged to keep insects and foreign material out of the vent tube.

4. The system of claim 1 including a vent tube communicating between the vacuum interface valve and an upper region of the valve chamber.

5. The system of claim 4 including a guard arranged to keep insects and foreign material out of the vent tube.

6. The system of claim 5 wherein the vent tube to the vacuum interface valve is arranged below a vent tube communicating between the controller and the guard to direct to the valve any condensate forming in the guard.

7. A system allowing internal breathing of a vacuum interface valve in a vacuum sewage system having a sewage collection sump remotely vented to atmosphere, a valve chamber holding the vacuum interface valve above the sump, and a partition separating the valve chamber and the sump, the system comprising:

a. a vent port in the partition allowing vent communication between the sump and the valve chamber when the vent port is open;

b. a float ball valve arranged to open the vent port whenever sewage in the sump is below a predetermined level and to close the vent port whenever the sewage in the sump is above the predetermined level; and c. a vent tube communicating between a controller of the vacuum interface valve and an upper region of the vent chamber so that the controller can breathe into and out of the valve chamber without having a breathing connection to the sump.

8. The system of claim 7 wherein the vent port is arranged to allow ground water entering the valve chamber to pass into the sump.

9. The system of claim 7 including a vent tube communicating between the vacuum interface valve and the upper region of the valve chamber.

10. The system of claim 9 including a guard inhibiting access to the vent tubes of insects and foreign material.

11. The system of claim 10 wherein the vent tube to the valve is arranged below the vent tube to the controller so that any condensation forming in the guard flows to the valve.

12. An internal breathing system for a vacuum interface valve for a vacuum sewage system having a wet sump remotely vented to atmosphere for collecting sewage for outflow and a chamber for the vacuum interface valve arranged above the wet sump without being vented above ground, the system comprising:

a. a controller for the vacuum interface valve being supplied with approximately atmospheric pressure air derived from the valve chamber;

b. the valve chamber receiving approximately atmospheric pressure air from the wet sump via a vent port in a partition between the wet sump and the valve chamber;

c. a float valve normally opening the vent port and being arranged for closing the vent port in response to sewage level reaching the float valve so that the float valve blocks passage of sewage from the sump into the valve chamber; and d. the controller receiving air from the valve chamber whenever the float valve is closed.

13. The system of claim 12 including a breather tube communicating between the controller and a location high in the valve chamber.

14. The system of claim 13 including another breather tube communicating between the valve and the location high in the valve chamber.

15. The system of claim 14 including a guard inhibiting entry into the breathing tubes of insects and foreign material.

16. The system of claim 15 wherein the other breather tube to the valve connects to the guard at a lower level than the breather tube to the controller so that any condensation forming in the guard is directed to the valve.

17. The system of claim 12 wherein the float valve in an open position permits passage of ground water from the valve chamber to the sump.

* * * * *